United States Patent [19]

Agostoni et al.

[11] Patent Number: 4,881,620

[45] Date of Patent: Nov. 21, 1989

[54] FOUR-LEG TRESTLEWORK STRUCTURE FOR SUPPORTING AN OFF-SHORE PLATFORM

[75] Inventors: Alberto Agostoni, Lissone; Alfredo D'Agostino, Gallarate; Enrico Craighero, Varese; Renzo Marazza, Milan, all of Italy

[73] Assignee: Tecnomare S.p.A., Venice, Italy

[21] Appl. No.: 201,216

[22] Filed: Jun. 2, 1988

[30] Foreign Application Priority Data

Jul. 15, 1987 [IT] Italy ..... 21288 A/87

[51] Int. Cl.[4] ..... E04G 1/04

[52] U.S. Cl. ..... 182/179; 52/638

[58] Field of Search ..... 182/178, 179, 113; 52/638, 648, 651

[56] References Cited

U.S. PATENT DOCUMENTS

| | | | |
|---|---|---|---|
| 1,341,335 | 5/1920 | MacIlwaine | 182/179 |
| 1,532,410 | 4/1925 | Kagiwada | 52/638 |

FOREIGN PATENT DOCUMENTS

| | | | |
|---|---|---|---|
| 69222 | 5/1958 | France | 182/179 |
| 1361387 | 4/1964 | France | 182/179 |
| 553562 | 12/1956 | Italy | 182/179 |
| 1012113 | 12/1965 | United Kingdom | 182/179 |

*Primary Examiner*—Reinaldo P. Machado

*Attorney, Agent, or Firm*—Morgan & Finnegan

[57] ABSTRACT

A trestlework structure provided with four main, legs forming an obelisk-shaped structure, wherein said main legs are positioned parallel to each another in correspondence of two mutually opposite faces of the obelisk and are reinforced at their base by jutting-out trestlework appendices lying on the planes of said faces.

Furthermore, variants are provided by the invention, according to which said legs are not positioned parallel to each other in correspondence of the top end of the structure, and said mutually-opposite faces of the obelisk are contained in two or more adjacent inclined planes.

4 Claims, 4 Drawing Sheets

FOUR-LEG TRESTLEWORK STRUCTURE FOR SUPPORTING AN OFF-SHORE PLATFORM

The present invention relates to a novel type of trestlework structure with fours legs, suitable for supporting an off-shore platform which, thanks to its particular structural shape, besides making it possible a considerable weight reduction—and hence a considerable material saving—to be obtained, with a consequent economic advantage, and at the same time the maximum functionality being maintained, renders extremely simpler or more advantageous the building thereof, and makes itself easier to lift by means of a crane-pontoon, and furthermore shows a large flexibility in use, in that it can be lifted and launched with no need for expensive purposely designed additional strengthening structures.

From the prior art, different four-leg trestlework structure for supporting off-shore platforms are known, and all these already known structures generally have an obelisk-shape, or a pyramid-frustum-shape with square or rectangular cross-section. In other terms, the structures known from the prior are have a base of square or rectangular shape, whose large and stocky dimensions are imposed by reasons of dynamic stability and in order to absorb as efficaciously as possible the loads deriving from meteomarine forces, such as waves, wind, streams, and so forth, as well as the vertical loads generated by the platform facilicities; from the vertices of said base the four legs then run upwards which, by converging towards one another, reach the top end at mutual distances which can easily match the dimensions of the off-shore platform to be supported.

Now then, such conventional, four-leg structures show a number of drawbacks.

In fact, owing to their large dimensions, such structures, or jackets, are generally built on a horizontal plane, i.e. laid on one of their faces, at suitable yards, generally far away from the landing-stages of the shipping pontoons, and hence provisions for transporting them to said landing-stages have to be made. This implies that for such structures and jackets also runways and launching paths and, therefore, additional structures have to be provided, which have a considerable weight and lead to complications in design, building and installation; furthermore, such structures are only used for the above-said task, and are useless during the operating life of the jacket. On the other hand, the presence of these additional structures also obliges to increase the corrosion protection, with a further increase in costs.

The considerable overall dimensions of the jacket on the side to which the lifting hook must be applied to it, besides requiring the structure to be strengthened in order to increase its stiffness on its lifting plane, clearly cause also considerable difficulties to be coped with in the operations of hooking and lifting of the same structure by the crane-pontoon.

The purpose of the present invention is therefore precisely that of providing a four-leg trestlework structure for supporting an off-shore platform, which not only does not require additional strengthening structures and guide structures for the launching operations, but even enables the weight of the same structure to be considerably reduced as compared to the weight of the traditional structures, while maintaining the maximum structural efficiency and the highest functionality.

This purpose is substantially achieved in that the present Applicant was able to experimentally and theoretically observe that it is possible to substantially reduce the weight of a four-leg trestlework structure, or jacket, for use in off-shore industry, without sacrificing, in the slightest, operability and reliability, by realizing its main legs positioned parallel to each another on the inclined planes of two of the mutually opposite side faces of the same structure, except in the upper end area, wherein they can also be not parallel to each other, in order to better match the dimensions of the platform to be supported.

Such a structural arrangement, in fact, by making it possible the parallel legs to be used as runways and launching paths and hence specific additional structures to be got rid of, enables the weight to be reduced by a value of the order of 20–30% as compared to the conventional structures, and steel and other components to be saved, which, owing to the dimensions in question, of some hundred metres, cause a decrease in costs which may be as high as 20–30 million U.S. dollars.

On the other hand, said structural arrangement enables the jacket to be directly lifted by the pontoon which ships it to the installation site, because, thanks to the small overall dimensions of the jacket on the side on which the lifting takes place, the crane-pontoon can perform its operating capabilities at its best. Then, the same concept of the structure spontaneously offer the greatest stiffness on the lifting plane, so that strengthening the jacket for this operation is no longer necessary.

Summing-up, the jackets according to the invention is perfectly suitable for being easily lifted, and launched; this is a requirement which, with the use of the by now adopted huge lifting super-pontoons becomes of extreme importance in the design-building-installation of such a structure.

Then, in order to supply the base with the necessary stiffness and stability as a function of the characteristics of the ground, of the number of the foundation poles, of the weight of the facilities on board of platform, and of the meteomarine conditions, according to the invention said base is extended on both said inclined planes on which the legs are positioned parallel to each other, by means of jutting-out trestlework appendices radiused to the same legs.

Finally, according to a different form of practical embodiment, and as a function of the necessary dimensions for matching the overhanging facility-bearing platform, each inclined plane of the side face of the structure which contains the parallel legs may be not a single plane, but the parallel legs may lay on two or more inclined planes adjacent to one another.

The invention is now better explained with particular reference to the hereto attached drawings, which depict a preferred form of practical embodiment given for merely exemplifying and non-limitative purposes, in that technical or structural changes may be supplied at any time, without departing from the scope of the present invention In said drawings.

Figure 1:
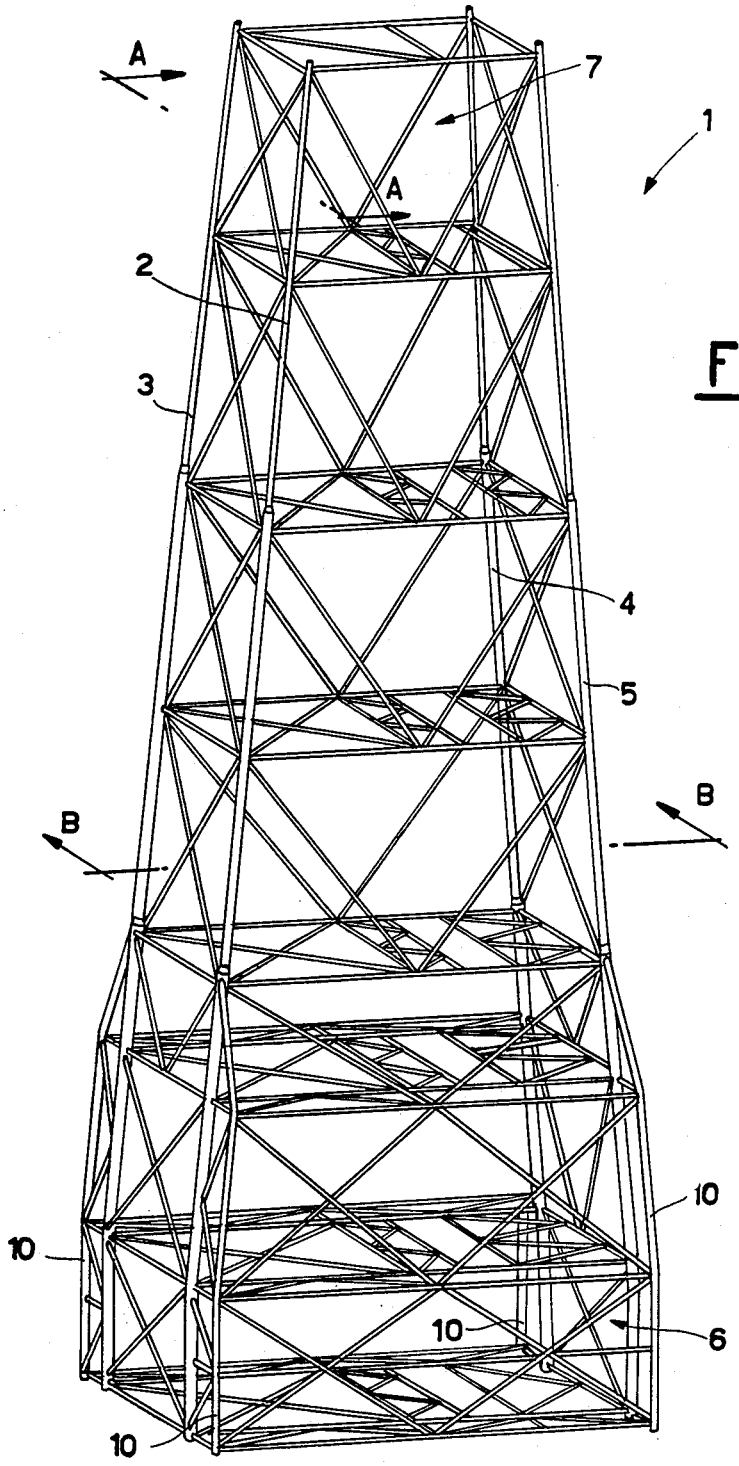
FIG. 1 shows a pespective view of a four-leg trestlework structure realized according to the present invention.

Referring to the figures, by the reference numeral 1 a four-leg trestlework structure is generally indicated, which is particularly suitable for supporting an off-shore platform, not shown in the figures, wherein said structure is realized according to the teachings of the present invention.

More specifically, the structure 1 is substantially constituted by four main legs, respectively 2, 3, 4 and 5, which, connected with one another by crossbeams and tie-rods to form an obelisk-shaped structure, run from a bottom base area 6 and converge to a top end area 7, which is the area which must match the plan of said off-shore facility-bearing platform.

Figure 3:
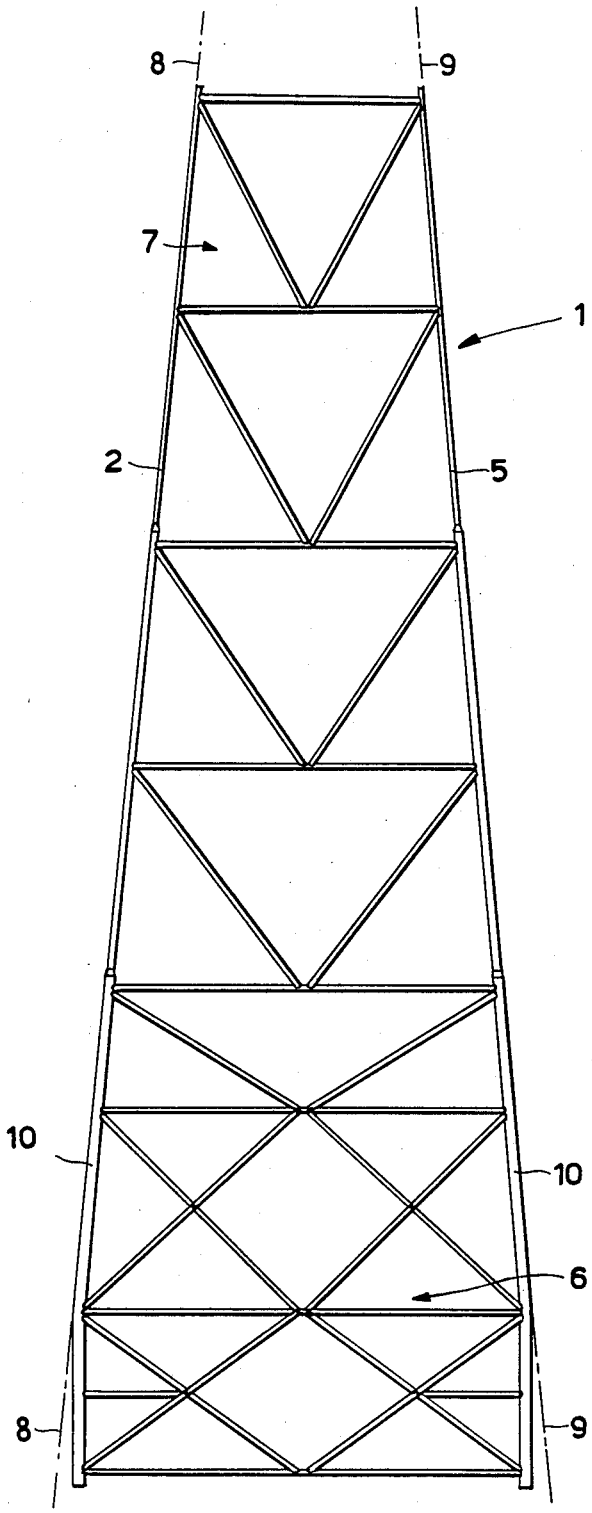
FIG. 3 shows a front view of the structure according to the present invention, made along path B—B of FIG. 1.

On the two inclined planes, whose traces are respectively indicated by the reference numbers 8 and 9 in FIG. 3, which contain the mutually opposite side faces of the structure 1, the legs, respectively 2, 3 and 4, 5, are positioned parallel to each other.

Figure 2:
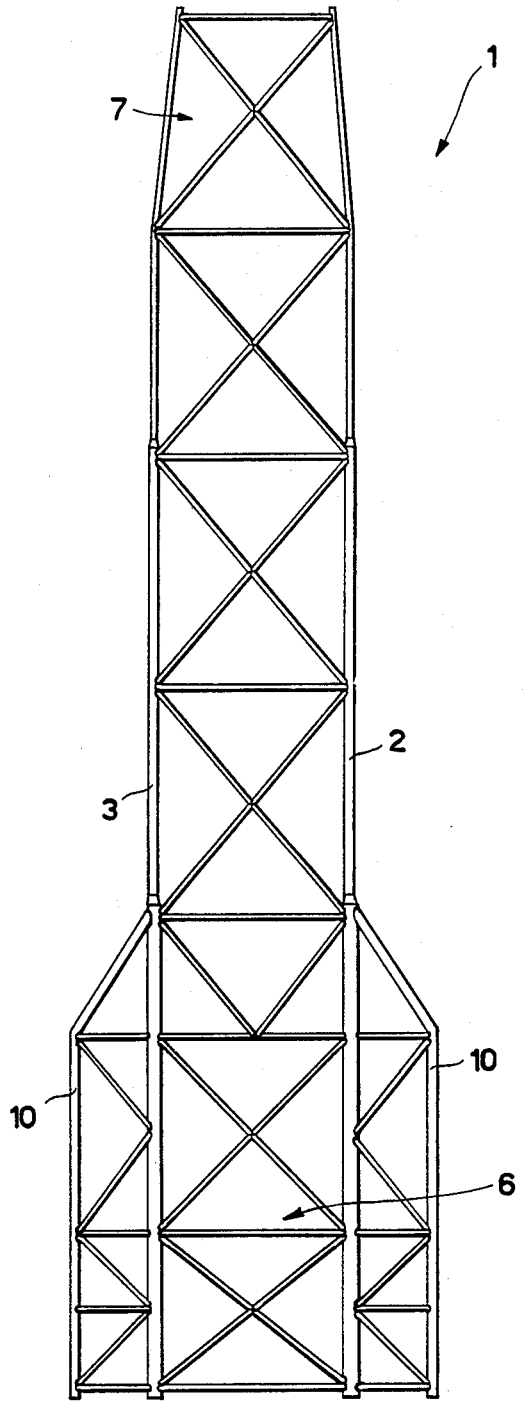
FIG. 2 shows a side view of the structure of the present invention, made along path A—A of FIG. 1: .

Said parallelism may be absent in said top end area 7, as one can clearly see from FIG. 2, in that, in order to be better able to match the dimensions of the platform to be supported, in that area the legs can be given a whatever desired configuration.

Finally, to the main legs 2, 3, 4 and 5, trestlework-shaped strengthening and stabilization appendices 10 are fixed in correspondence of said bottom base area 6, wherein said appendices 10 jut out from the structure along the direction of said inclined planes on which said leg couples are arranged in parallel fashion.

Figure 4:
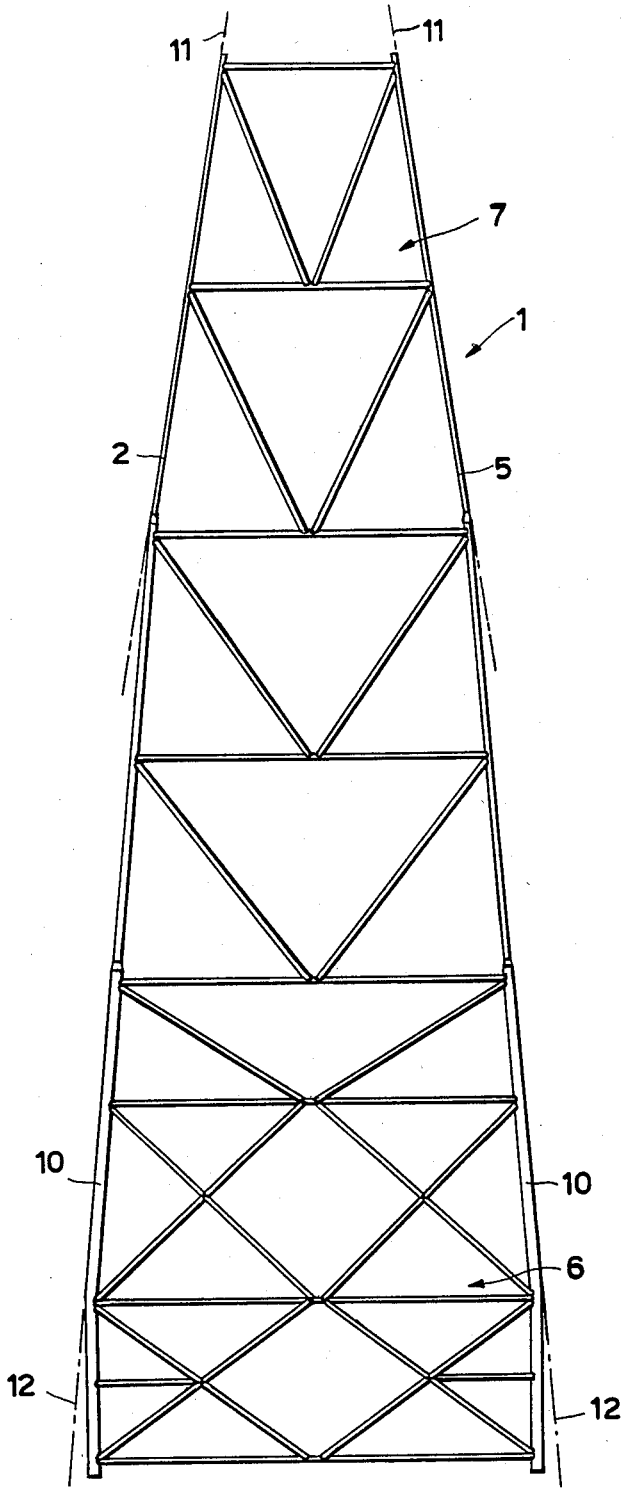
FIG. 4 shows a front view of a four-leg trestlework structure realized according to a variant of the present invention.

In FIG. 4, a variant of the invention is shown on the contrary, according to which the parallel legs 2, 3 and respectively 4, 5 are not each contained on one inclined plane only, but on two adjacent inclined planes, whose traces are respectively indicated by the reference numerals 11 and 12.

We claim:

1. An improved, four-legged obelisk shaped trestlework structure for supporting an off-shore platform comprising:

an obelisk frame having ends and sides, said frame having a bottom base area, a middle area and a top end area and four tapered main leg members;

said four tapered main leg members having a lower section, a middle section and an upper section where said lower section is larger than said middle section and said middle section is larger than said upper section;

said bottom base area comprising two mutually opposite inclined plane side faces, two mutually opposite side faces, one bottom face and said lower section of said four tapered main leg members and correspondingly four main trestlework appendices;

said four tapered main leg members of said bottom base area are connected to each other by crossbeams and tie-rods and run upward from said bottom face;

said four tapered main leg members of said bottom base area are positioned parallel to each other on said two mutually opposite inclined plane side faces;

said middle area comprising two mutually opposite inclined plane side faces, two mutually opposite side faces and said middle section of said four tapered main leg members;

said four tapered main leg members of said middle area are connected to each other by crossbeams and tie-rods and run upward from the top of the four tapered main leg members of said bottom base area;

said four tapered main leg members of said middle area are positioned parallel to each other on said two mutually opposite inclined plane side faces;

said top end area comprising two mutually opposite inclined plane side faces, two mutually opposite side faces, one top face and said top end area of said four tapered main leg members;

said four tapered main leg members of said top end area are connected to each other by crossbeams and tie-rods and run upward from the top of the four tapered main leg members of said middle area;

said four-tapered main leg members of said top end area are positioned parallel to each other on said two mutually opposite inclined plane side faces; and said top face matches the plan of said off-shore platform.

2. Four-legged structure according to claim 1 wherein said four tapered main leg members in said top end area are positioned in any configuration so as to match the plan of said off-shore platform.

3. Four-legged structure according to claim 1 wherein said inclined planes in which the four tapered main leg members are positioned parallel to each other are each constituted by two or more adjacent inclined planes.

4. Four-legged structure according to claim 1 wherein said four main trestlework appendices jut out from the structure along the direction of said inclined planes on which said four tapered main leg members are arranged in parallel.

* * * * *